US009849409B2

(12) United States Patent
Jones

(10) Patent No.: US 9,849,409 B2
(45) Date of Patent: Dec. 26, 2017

(54) WATER RECLAIMING CONTAINER

(71) Applicant: E. David Jones, Modesto, CA (US)

(72) Inventor: E. David Jones, Modesto, CA (US)

( * ) Notice: Subject to any disclaimer, the term of this patent is extended or adjusted under 35 U.S.C. 154(b) by 302 days.

(21) Appl. No.: 14/881,204

(22) Filed: Oct. 13, 2015

(65) Prior Publication Data

US 2017/0100684 A1 Apr. 13, 2017

(51) Int. Cl.

| | |
|---|---|
| ***B01D 29/05*** | (2006.01) |
| ***C02F 1/00*** | (2006.01) |
| ***B01D 29/94*** | (2006.01) |
| ***B01D 29/76*** | (2006.01) |
| *C02F 103/00* | (2006.01) |
| *C02F 103/32* | (2006.01) |

(52) U.S. Cl.

CPC ..... *B01D 29/05* (2013.01); *B01D 29/76* (2013.01); *B01D 29/94* (2013.01); *C02F 1/001* (2013.01); *C02F 2103/002* (2013.01); *C02F 2103/32* (2013.01)

(58) Field of Classification Search

None

See application file for complete search history.

(56) References Cited

U.S. PATENT DOCUMENTS 586,833 A * 7/1897 Brown ..... A47J 43/24 210/464
770,169 A * 9/1904 Davis ..... E01H 5/102 126/343.5 R
852,472 A * 5/1907 Tracey ..... A47J 36/08 210/469
1,137,462 A * 4/1915 Clark ..... A47J 36/08 210/469
1,173,374 A * 2/1916 Nolda ..... A47J 43/24 210/464
1,174,518 A * 3/1916 Nolda ..... A47J 43/24 210/464
1,269,902 A * 6/1918 Butler ..... A47J 36/08 210/469
1,847,879 A * 3/1932 Knecht ..... A47G 19/2211 138/103
2,106,453 A * 1/1938 Ekdahl ..... A47G 19/2211 210/469
2,136,755 A * 11/1938 Prince ..... A47G 19/2211 210/464
2,198,059 A * 4/1940 Pistorius ..... A47G 19/2211 210/469
2,357,063 A * 8/1944 Swing ..... A47G 19/2211 210/469
D173,121 S * 9/1954 Lynn ..... D7/620
2,690,064 A * 9/1954 Rupe ..... A47G 19/2211 210/464

(Continued)

*Primary Examiner* — Robert James Popovics

(74) *Attorney, Agent, or Firm* — Jeffrey M. Furr, Esq.; Furr Law Firm

(57) ABSTRACT

The invention is a gray water reclaiming container and system. It is comprised of two containers, an inner container which captures liquids destined for drainage and an outer liquid container for reclaiming water. There is a screen on the top of the inner container allowing ice to be filtered from liquid drinks as ice is fresh water which usually gets thrown away in cups into the trash can. The ice goes to the outer liquid container where it is melted into usable water.

1 Claim, 6 Drawing Sheets

(56) References Cited

U.S. PATENT DOCUMENTS 2,744,631 A * 5/1956 Toombs ..... A47G 19/2211 210/469
2,748,946 A * 6/1956 Smith ..... A47G 19/2211 210/244
2,753,049 A * 7/1956 Gaines ..... A47G 19/2211 210/469
2,753,050 A * 7/1956 Langston ..... A47G 19/2211 210/469
2,766,889 A * 10/1956 Rey ..... A47G 19/2211 210/469
3,150,084 A * 9/1964 Rodges ..... A47G 19/2211 210/463
3,250,081 A * 5/1966 Othmer ..... B01D 9/0009 62/535
3,664,145 A * 5/1972 Johnson ..... C02F 1/22 62/123
3,752,320 A * 8/1973 Biro ..... A47G 19/2211 210/469
3,859,069 A * 1/1975 Seliber ..... C02F 1/22 62/537
3,917,533 A * 11/1975 Macaluso, Jr. .... A47G 19/2211 210/469
3,940,012 A * 2/1976 Addington ..... A47G 19/2211 215/390
4,020,532 A * 5/1977 Lichter ..... A47G 19/2211 210/469
4,356,015 A * 10/1982 Oliver ..... C02F 1/22 62/532
4,478,346 A * 10/1984 Spong ..... A47G 19/2272 220/521
4,668,345 A * 5/1987 Warren ..... B01D 1/2887 159/24.3
4,898,298 A * 2/1990 Norris ..... B65D 47/06 215/387
4,938,375 A * 7/1990 Fantacone ..... A47G 19/2211 210/464
D312,560 S * 12/1990 Williamson ..... D7/667
D315,478 S * 3/1991 Liggens ..... D7/667
D315,479 S * 3/1991 Liggens ..... D7/667
5,024,757 A * 6/1991 Malak ..... B01D 29/03 210/136
D345,889 S * 4/1994 Herricks ..... D7/392.1
D353,298 S * 12/1994 Hartpence, Jr. ..... D7/396.2
5,394,706 A * 3/1995 Keus ..... B01D 9/0013 62/123
5,400,619 A * 3/1995 Husseiny ..... C02F 1/22 62/123
5,536,411 A * 7/1996 Blades ..... C02F 1/441 210/638
5,685,978 A * 11/1997 Petrick ..... B01D 29/03 209/249
5,702,024 A * 12/1997 Riso ..... A47G 19/2211 220/704
5,727,712 A * 3/1998 Costello ..... A47G 19/2211 220/703
5,853,106 A * 12/1998 Galluzzo ..... A47G 19/2211 220/703
5,860,558 A * 1/1999 Fahy ..... A47G 19/2211 220/719
D407,944 S * 4/1999 Filbrun ..... D7/388
5,971,202 A * 10/1999 Filbrun ..... A47G 19/2211 220/719
6,247,212 B1 * 6/2001 Grana Iglesias ... A47G 19/2211 210/469
7,467,526 B2 * 12/2008 Hsieh ..... C02F 1/22 62/532
8,113,378 B2 * 2/2012 Wassmann ..... A47G 19/22 215/239
8,459,492 B2 * 6/2013 Merino ..... A47G 19/2211 215/389
D686,877 S * 7/2013 Ortega ..... D7/396.2
8,871,101 B2 * 10/2014 Davidian ..... B01D 17/0214 210/167.02
8,956,542 B1 * 2/2015 Wakayama ..... C02F 1/22 210/198.1
9,320,374 B2 * 4/2016 Phipps ..... A47G 19/02
9,677,235 B2 * 6/2017 Myrhaug ..... E01H 5/102
2005/0194307 A1 * 9/2005 Fenyes ..... A47J 43/284 210/464
2006/0175235 A1 * 8/2006 Hsieh ..... C02F 1/22 210/175
2011/0290742 A1 * 12/2011 Myrhaug ..... E01H 5/102 210/767
2013/0071187 A1 * 3/2013 Lowe ..... E02B 15/02 405/61
2013/0087514 A1 * 4/2013 Davidian ..... B01D 17/0214 210/800
2015/0038760 A1 * 2/2015 Wakayama ..... C02F 1/22 588/2
2015/0321127 A1 * 11/2015 Arent ..... E03C 1/264 210/232
2017/0100684 A1 * 4/2017 Jones ..... B01D 29/05
2017/0183834 A1 * 6/2017 Myrhaug ..... E01H 5/102

* cited by examiner

WATER RECLAIMING CONTAINER

CROSS-REFERENCE TO RELATED APPLICATIONS

None.

STATEMENT AS TO RIGHTS TO INVENTIONS MADE UNDER FEDERALLY SPONSORED RESEARCH AND DEVELOPMENT

None

FIELD OF THE INVENTION

This device refers to the field of water reclaiming in more particularity containers to be used with beverages.

BACKGROUND OF THE INVENTION

The importance of recycling and reclaiming water has never been more important. With the droughts around the world in such places such as California makes the need for making water go farther very important. The need to have the ability to recycle and reclaim water has never been greater.

In the restaurant and food services areas as well as homes, the combining of liquids in waste containers, plus mixing with vegetable and animal waste, causes degeneration of paper products into toxicmess. Liquids add 70 percent of weight to garbage bags hence there is a need to separate these types of products, IE: liquids, animal and vegetable matter in trash bags less they turn into toxic garbage.

In restaurants and home applications etc, traditional waste management process is to simply place all items of waste into one generic black liner bag. liquids and solids have always traditionally been placed in one bag. As packaging of food comprises all types of resources and material, the discharge of these materials can no longer tolerate placement in one generic bag. This usually generates toxic liquids and matter which does not facilitate recycling.

Many communities such as Modesto, California are adding Ordinances like MODESTO MUNICIPAL CODE ORDNANCE NO. 3630-C.S. which is an ordinance pertaining to food service establishment wastewater and fats, oils and greases. With these issues effecting water, Fats, Oils and Greases "FOG" continuing to grow, more and more communities are expected to pass such ordinances.

There remains room for improvement in the art.

SUMMARY OF THE INVENTION

This proposed device 1 is a device and process for use with the reclaiming of water.

The current invention is a is a gray water reclaiming container and system. It is comprised of two containers, an inner container, which captures liquids destined for drainage, and an outer liquid container for reclaiming water. There is a screen on the top of the inner container allowing ice to be filtered from liquid drinks as ice is fresh water which usually gets thrown away in cups into the trash can. The ice goes to the outer liquid container where it is melted into usable water. This usable water can be used and recycled into lawns, gardens or even used in the sanitary system to flush toilet.

There can be a filter prior to pump connected to outer container that is used to pump the recycled water out for its specific purpose of remelting ice and other secondary purposes. The inner container can have drainage with a drain and run off pipe to remove the waste from the inner container for disposal.

BRIEF DESCRIPTION OF DRAWINGS

Without restricting the full scope of this invention, the preferred form of this invention is illustrated in the following drawings in which.

DETAILED DESCRIPTION OF THE PREFERRED EMBODIMENT

There are a number of significant design features and improvements incorporated within the invention.

The current invention is a is a gray water reclaiming container and system.

This proposed device is a device and process for use with the reclaiming of water.

Figure 1:
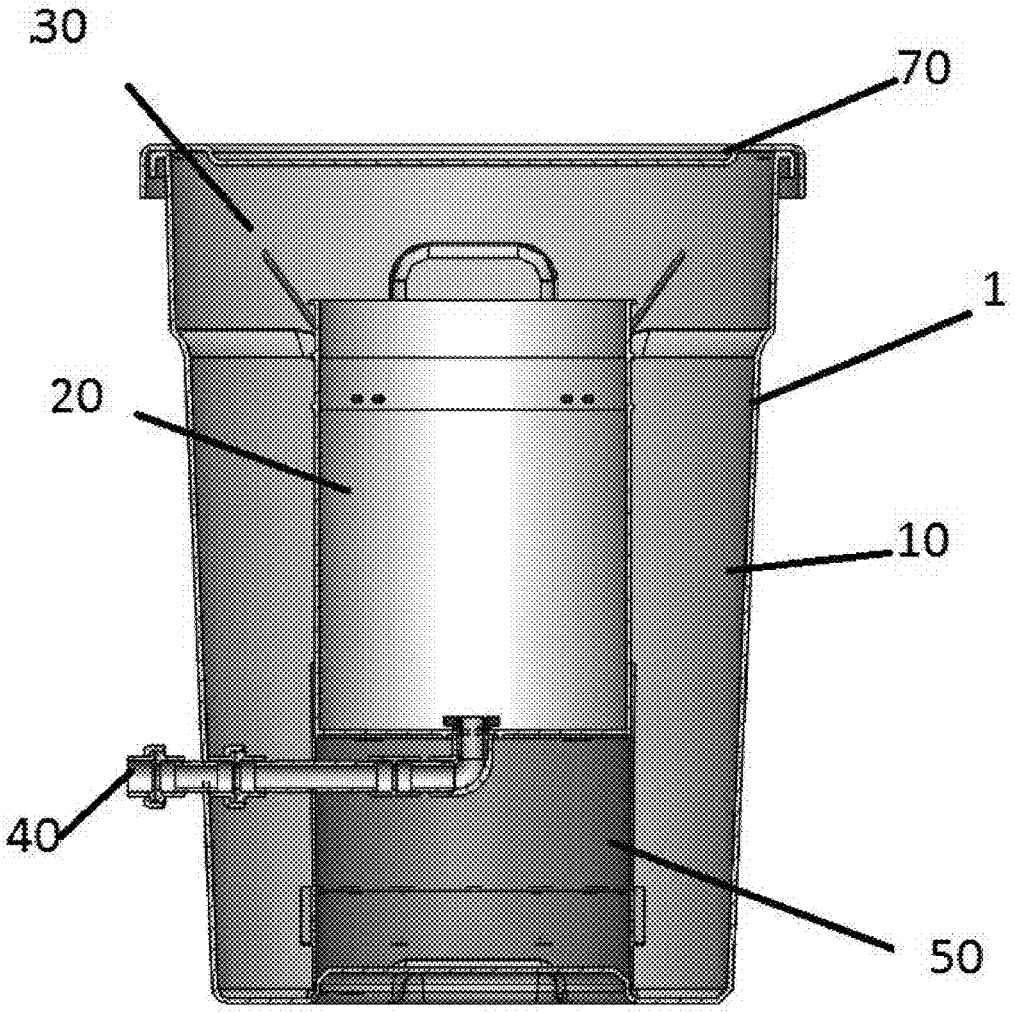
FIG. 1 shows the device.
Figure 2:
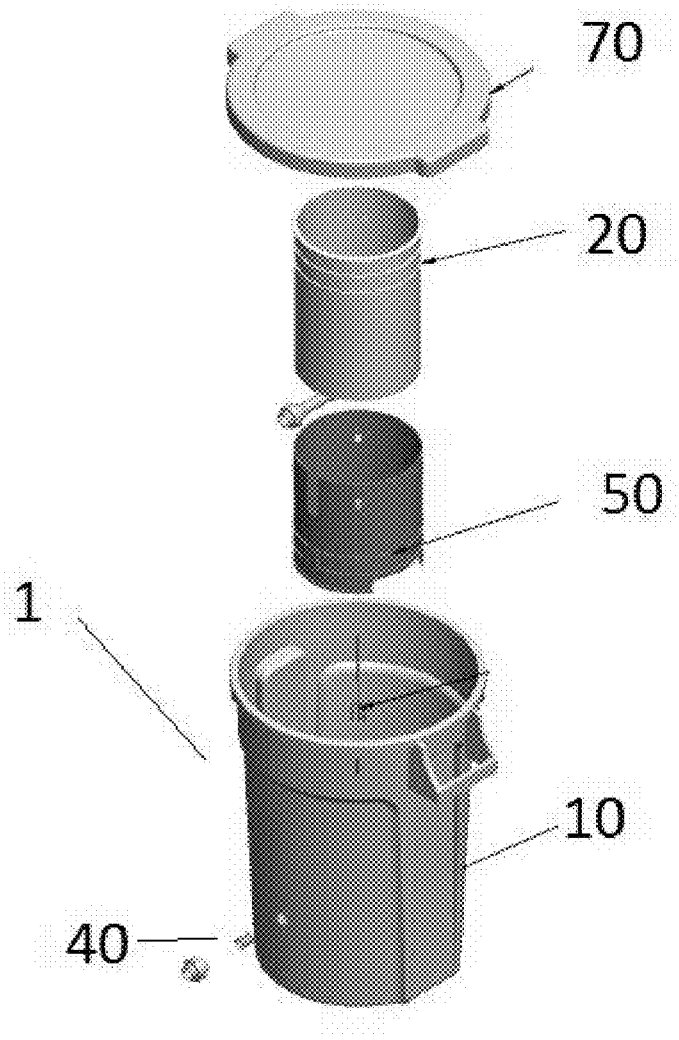
FIG. 2 shows an expanded view of the device.

The current invention, a water reclaiming container 1 as shown in FIG. 1, is comprised of two containers, an inner container 10 which captures liquids destined for drainage and an outer liquid container 20 for reclaiming water. The components of the device 1 are shown in FIG. 2.

Figure 3:
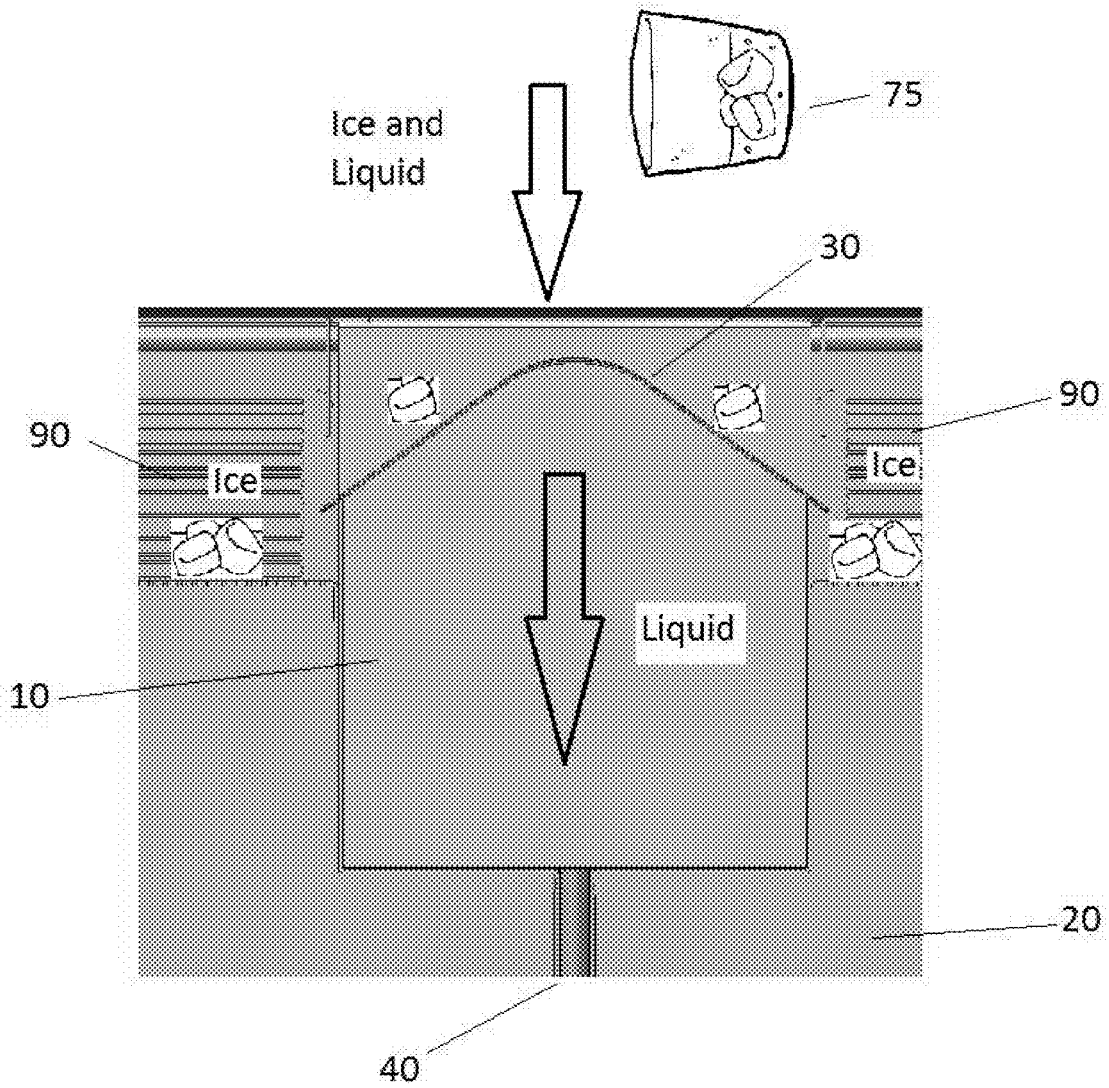
FIG. 3 shows how the process works with the ice blocking screen.

There is an inner container ice screen 30 that covers and is on the top of the inner container 10 allowing ice to be filtered from liquid drinks as ice is fresh water which usually gets thrown away in cups into the trash can. The glass 75 with its contents would be poured through the inner container ice screen 30. This is shown in FIG. 3. The inner container ice screen 30 would contain the ice while the waste liquid would flow to the inner container 10. The ice goes to the outer liquid container 20 after being held in container 90 where it is melted into usable water. This usable water can be used and recycled into lawns, gardens or even used in the sanitary system used to flush toilets and other sanitary facilities. In the preferred embodiment the inner container ice screen 30 would be angled, as shown in FIG. 3, so that the ice would naturally fall into the outer container 90. The inner container ice screen 30 can have multiple angles so that the ice is properly directed into the outer container 20 or to one or more ice storage screens 90.

In the preferred embodiment the inner container 10 would have a drain and cutoff valve 40 which allows for the easy emptying and disposing of the waste liquid made up of the liquids from the drinks. This liquid is to be properly disposed of using the best economical means possible. The drain would be located at the bottom of the inner container 10 so that there could not be a need to pump the waste liquid out of the inner container 10.

In some embodiments, the device 1 would have an inner container support 50 which supports and holds the inner container 10. This inner container support 50 can be a circular tube with a edge where the inner container 10 rests. The inner container support 50 would have a slightly larger circumference than the inner container 10. The inner container support 50 may also have a slot or opening for the inner container drain and cutoff valve 40. The inner container support 50 can be of any type of support that would hold up the inner container 10. It can be legs or even attached to the walls of the outer container 20. In the preferred embodiment, the inner container support 50 would have holds or openings that would allow the water to flow through it as not to limit the storage capacity of the outer container 20.

Figure 4:
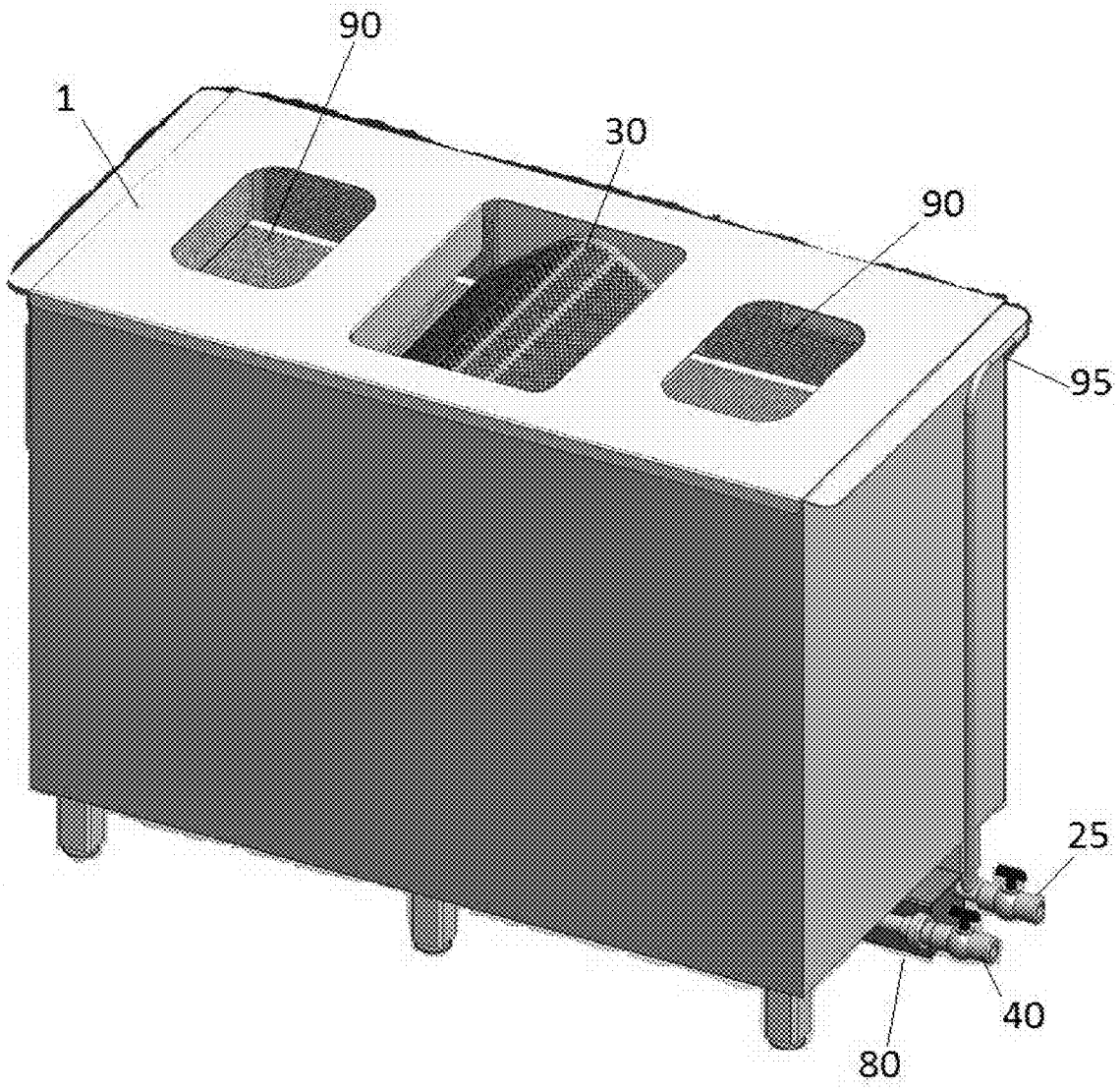
FIG. 4 displays an additional embodiment for large facilities.
Figure 5:
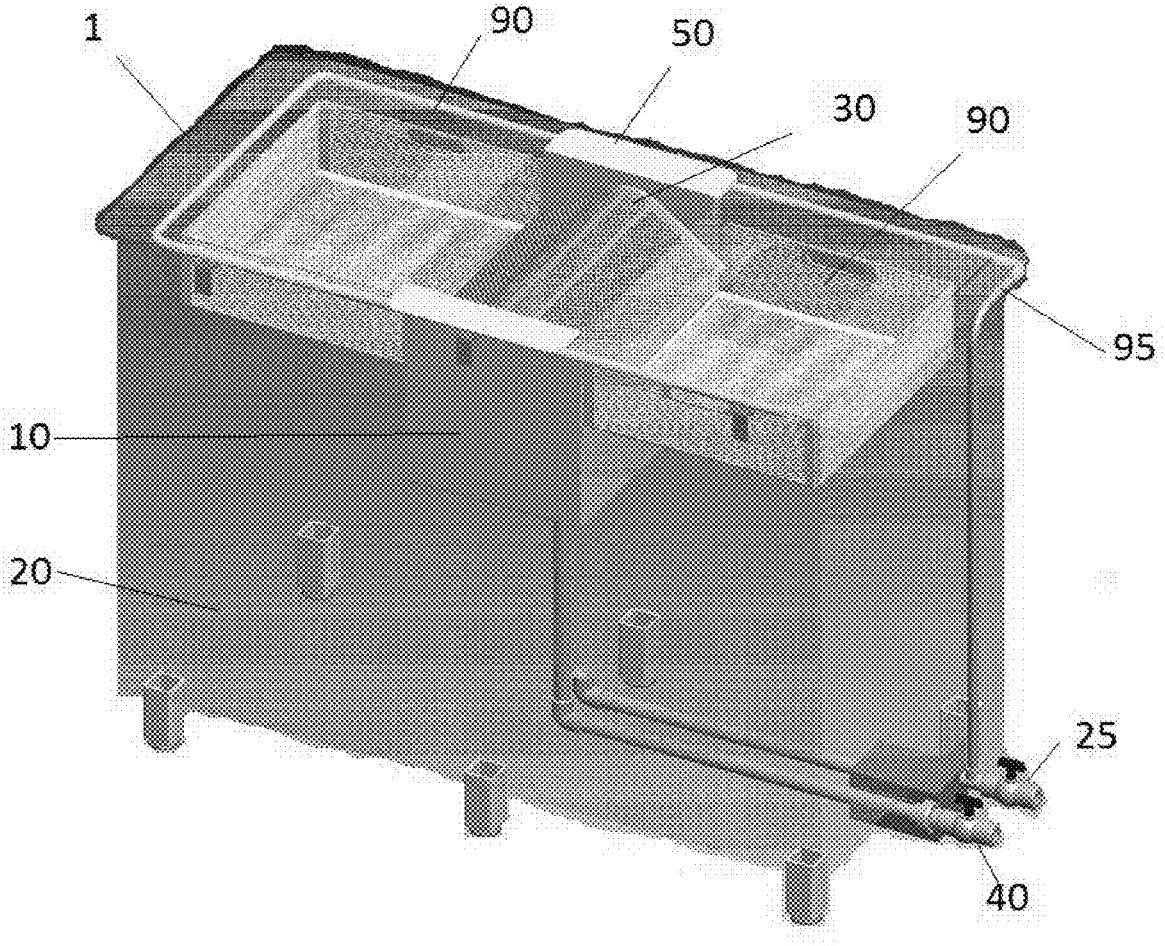
FIG. 5 display a transparent view of embodiment for large facilities.
Figure 6:
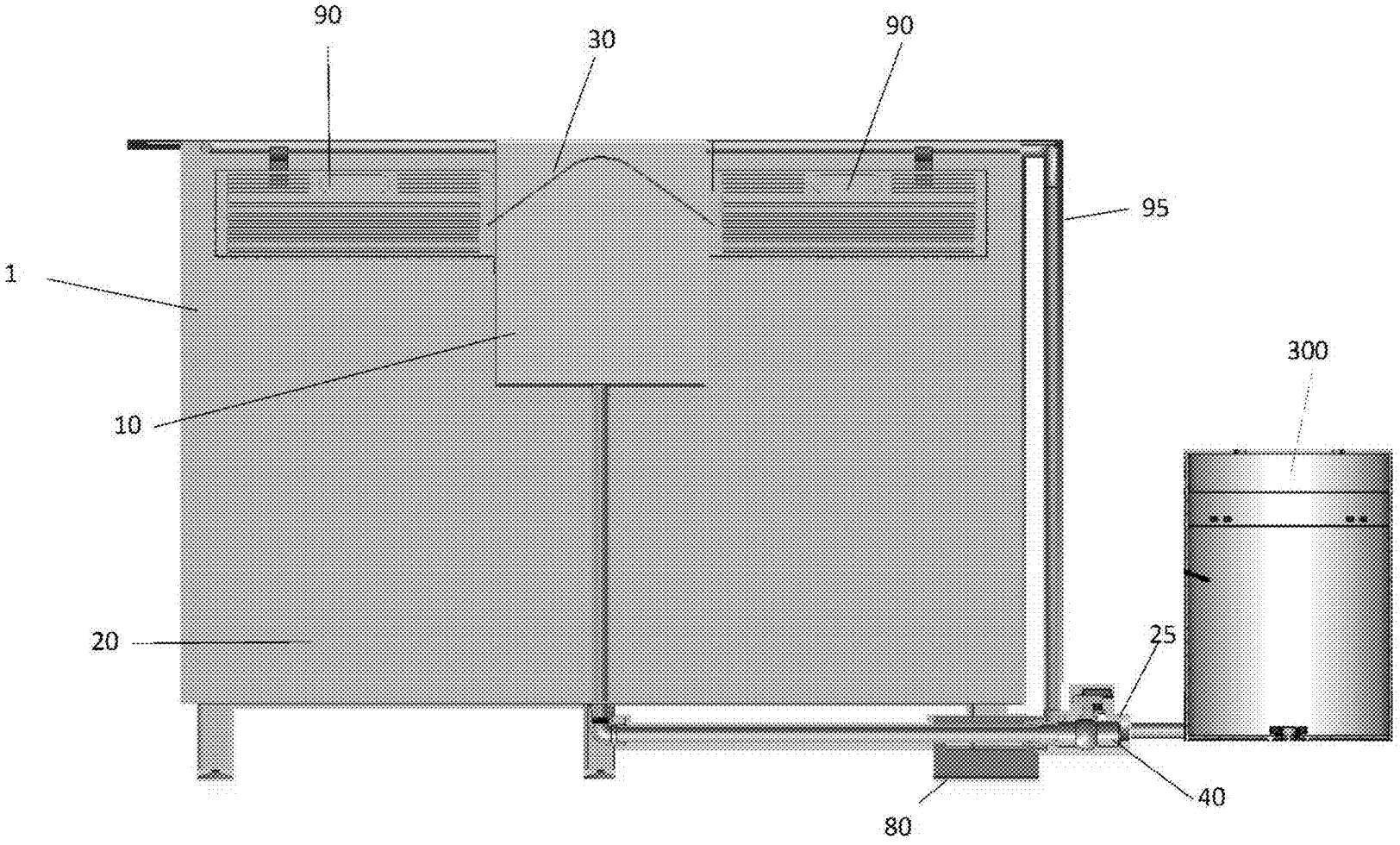
FIG. 6 display a cross view of embodiment for large facilities.

FIGS. 4, 5 and 6 display another embodiment of the current invention. This embodiment is designed for larger users such as large restaurants. This embodiment has a rectangular body which serves as the outer container 20. In this configuration the inner ice screen 30 is in the middle and the ice drops into a pair of ice storage screens 90 where the ice is held until it is melted and flows into the outer container 20. The inner container 10 is in the center of the of the water reclaiming canister device 1. This configuration allows for multiple user to use it as well as handling a large amount of volume. The inner container support 50 are lips at the top of the inner container 10. FIG. 5 is a cut away view of the device 1. In this configuration the water reclaiming canister device 1 has legs.

The outer container 20 can also have a drain and cutoff valve 25 as shown in FIGS. 4 and 5. There can be a pump 80 connected to outer container 20 that is used to pump the recycled water out for its specific purpose. It can also be used to pump the water to melt the ice through ice melting tubes 95. This melting tubes 95 can be set up to run water over the ice held in ice storage screens 90 by means of holes in tube and or emiters to melt captured ice in the ice container 90, for recycling. Ice unless re-melted, has long life time and would slow the recycling process if required to wait for all ice to melt. The pump 80 would be designed to pump the water up to 15 feet.

Once water is reclaimed in Liquid reclamating canister, it can be sent to a holding tank/reservoir 300 where it is temporarily held until it can be used. It can be used to flush toilet bowl or urinals, or drained into lawn application, even be sent to various filtration systems for further processing.

In the preferred embodiment, the smaller versions of the device are made of a plastic for ease on cleaning and to make sure that the weight of the system is not too much so that it can be moved easily. In the larger embodiments lightweight aluminum can be used.

The water reclaiming container 1 can be made of any shape or size. It can even be built for table top sizes for a single person to use. With today's droughts and shortages of water people cannot afford to waste any usable water.

The water reclaiming container 1 can be a significant part of a waste management collection system ("WMC"). The WMC is a System that focuses on recycling. The purpose is to make sure "trash" is not turned into "garbage". The WMC facilitates separation of packaging and water resources to facilitate ease of recycling these very valuable commodities. The WMC has several compartments which separates various types of trash IE, paper, tissue, go into one compartment, vegetable and animal waste go into their respective compartments, plastic knives forks in another, while cups, after being emptied into the liquid reclamation canister 1 get stacked into their respective compartments for recycling, As to a further discussion of the manner of usage and operation of the present invention, the same should be apparent from the above description. Accordingly, no further discussion relating to the manner of usage and operation will be provided.

With respect to the above description, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur by those skilled in the art, it is not desired to limit the invention to the exact construction and operation shown and described, and accordingly, all suitable modifications and equivalents may be resorted to, falling within the scope of the invention.

I claim:

1. A method of separating ice from a mixture of ice and waste liquid beverage comprising the steps of:

providing an ice separation apparatus including:

an inner container having an open top;

an angled screen extending across said open top;

an outer container positioned about a lower end of said angled screen for receipt of ice separated from said ice and waste beverage mixture;

pouring said ice and waste liquid beverage mixture onto said angled screen, causing said waste liquid beverage to pass through said angled screen into said inner container while said ice is directed into said outer container;

disposing of waste liquid beverage accumulated within said inner container;

allowing ice contained within said outer container to melt; and recycling the melted ice to a gray water application.

* * * * *